US008708303B2

(12) United States Patent
Bigelow

(10) Patent No.: US 8,708,303 B2
(45) Date of Patent: Apr. 29, 2014

(54) HANGING DEVICE

(76) Inventor: Herbert Mark Bigelow, Cedar Lake, IN (US)

( * ) Notice: Subject to any disclaimer, the term of this patent is extended or adjusted under 35 U.S.C. 154(b) by 1132 days.

(21) Appl. No.: 10/904,729

(22) Filed: Nov. 24, 2004

(65) Prior Publication Data

US 2005/0109911 A1 May 26, 2005

Related U.S. Application Data

(60) Provisional application No. 60/524,746, filed on Nov. 25, 2003.

(51) Int. Cl.
*A47G 1/16* (2006.01)

(52) U.S. Cl.
USPC ..... 248/498; 248/475.1; 248/489

(58) Field of Classification Search
USPC ..... 248/475.1, 477, 489, 496, 497, 498; D8/373, 371
See application file for complete search history.

(56) References Cited

U.S. PATENT DOCUMENTS

| | | | | |
|---|---|---|---|---|
| 814,163 | A | 3/1906 | Pursell | |
| 1,223,802 | A | 4/1917 | Kuhn | |
| 1,600,919 | A | 9/1926 | Baalsrud et al. | |
| 2,099,332 | A | 3/1936 | Di Nuccio | |
| 2,688,901 | A * | 9/1954 | Haugaard | 248/476 |
| D203,538 | S * | 1/1966 | Di Nuccio | D8/373 |
| D208,531 | S * | 9/1967 | Douglass | D25/142 |
| D224,703 | S * | 9/1972 | Kiner | D25/142 |
| 4,003,539 | A * | 1/1977 | Gutner | 248/489 |
| D244,748 | S * | 6/1977 | Canterbury | D8/380 |
| D258,465 | S * | 3/1981 | Studinski | D25/142 |
| 4,461,593 | A * | 7/1984 | Rodseth | 403/11 |
| D282,525 | S | 2/1986 | Samson et al. | D8/373 |
| D291,315 | S * | 8/1987 | Belford et al. | D8/373 |
| 5,048,788 | A | 9/1991 | Lorincz | 248/477 |
| 5,236,168 | A | 8/1993 | Roy | 248/546 |
| D397,927 | S | 9/1998 | Roy | D8/373 |
| 6,129,113 | A * | 10/2000 | Van Becelaere | 137/557 |

FOREIGN PATENT DOCUMENTS

NL 1006440 C2 * 1/1999 ..... A47G 1/20

OTHER PUBLICATIONS

Master Catalog; McNichols Co.

* cited by examiner

*Primary Examiner* — Gwendolyn W. Baxter
(74) *Attorney, Agent, or Firm* — Mendelsohn, Drucker & Dunleavy, P.C.; Kevin M. Drucker

(57) ABSTRACT

A device for hanging an object on a vertical structure, such as a framed picture or painting on a wall. The device comprises a body having a planar portion that lies in a plane defining a first direction and a second direction transverse to the first direction. A plurality of openings are present in the planar portion, and the openings are arranged in a two-dimensional pattern so that each opening is offset in the first and second directions from at least a second of the openings. The device further includes a feature for securing the body to the object.

2 Claims, 4 Drawing Sheets

HANGING DEVICE

CROSS REFERENCE TO RELATED APPLICATIONS

This application claims the benefit of U.S. Provisional Application No. 60/524,746 filed Nov. 25, 2003.

BACKGROUND OF THE INVENTION

The present invention generally relates to devices for hanging objects such as framed pictures and paintings on a surface, such as a wall or other support structure. More particularly, this invention relates to a hanging device formed to have a plurality of openings that provide adjustability in essentially any direction in the plane of the surface on which the device is to hang the object.

A variety of devices are known for hanging objects such as framed pictures and paintings on a wall or other surface. Such devices, which include wires and brackets, are typically attached to the back of the object and adapted for engaging a nail or similar item secured in the wall. To simplify the hanging operation, various hanging devices have been proposed that provide multiple points which a support nail can engage. As an example, U.S. Pat. No. Des. 282,525 to Samson et al. depicts a version of the widely-available sawtooth-notched hanger. Another example is U.S. Pat. No. 5,048,788 to Lorincz, which discloses a hanging device with a single aperture that defines a horizontal row of channels from which an object can be hung from a nail by inserting the nail head into one of the channels. These types of hanging devices are usually individually used to allow the user to adjust the horizontal tilt of the object by inserting the nail into the notch, channel, etc., that is most nearly vertically above the object's center of gravity, and then pivoting the object about the nail to level the object. However, these devices are not adapted to provide any degree of vertical repositioning of the object, and horizontal repositioning is very limited since hanging the object from a notch/channel that is not vertically above the center of gravity will inevitably result in the object becoming tilted. Consequently, care must be taken when locating the nail on the wall, and any horizontal and vertical repositioning of the object requires moving the nail on the wall or moving the hanging device on the object, neither of which is desirable from the standpoint of ease and minimizing damage to the object and wall. If the object is one of multiple objects that are to be hung together, arranging the objects to provide a desired spacing between objects can require the process to be repeated several times.

In view of the above, it would be desirable if an improved hanging device were available that provided the capability of both horizontal and vertical adjustment of the object being hung.

BRIEF SUMMARY OF THE INVENTION

The present invention provides a device for hanging an object on a vertical surface, such as a framed picture or painting on a wall. The device comprises a body having a planar portion that lies in a plane defining a first direction and a second direction transverse to the first direction. A plurality of openings are present in the planar portion, and the openings are arranged in a two-dimensional pattern so that each opening is offset in the first and second directions from at least a second of the openings. The device further includes means for securing the body to the object.

In view of the above, by securing the body of the device to a frame (or other object), the openings are presented on the frame so that the frame can be hung with a nail (or other spike-like member) protruding from a wall (or other vertical structure) by inserting the head of the nail into any one of the openings. Because the openings are offset from each other in the first and second directions, horizontal and vertical repositioning of the frame on the wall can be achieved by selectively inserting the nail head into a different opening. If a number of closely-packed openings are present on the device to enable small incremental adjustments, the device can be used in combination with a second essentially identical device, with each device secured to the frame and each engaged with a nail in the wall. The exact position of each nail is less critical as a large number of closely-spaced openings allows for vertical and horizontal misalignments between the nails.

Other objects and advantages of this invention will be better appreciated from the following detailed description.

DETAILED DESCRIPTION OF THE INVENTION

Figure 8:
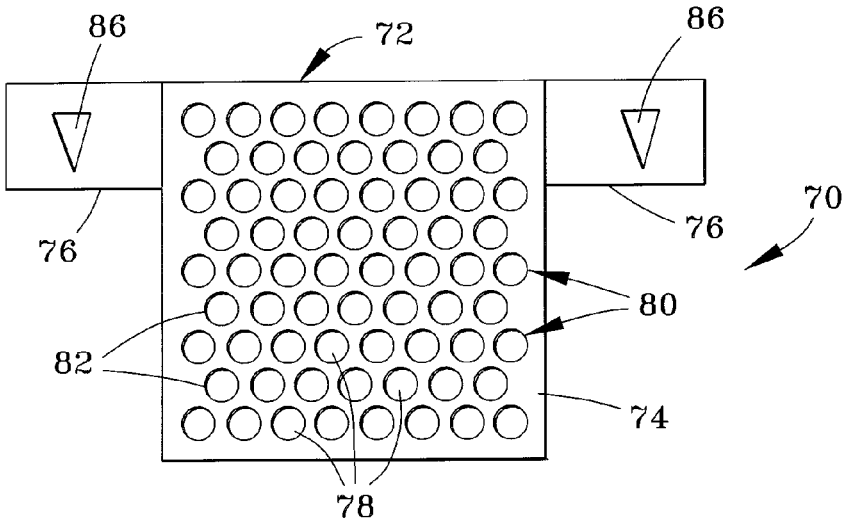
FIG. 8 is a plan view of the hanger of FIG. 7 following a forming operation.
Figure 9:
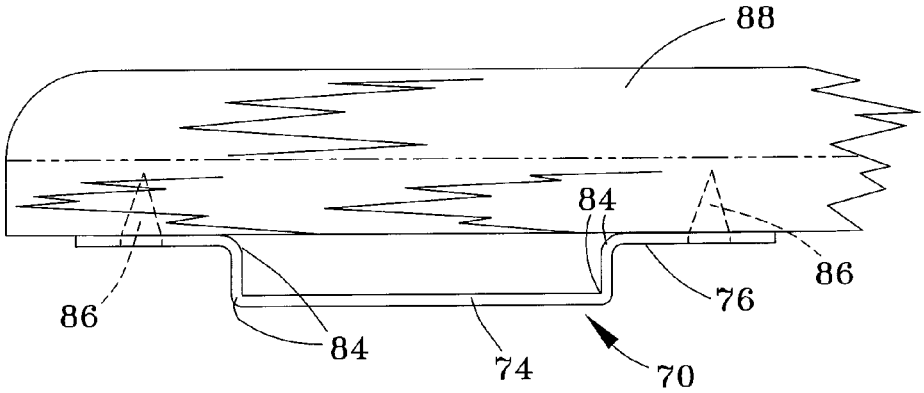
FIG. 9 is a side view of the hanger of FIG. 8, showing the hanger secured to a frame with integrally-formed prongs.
Figure 10:
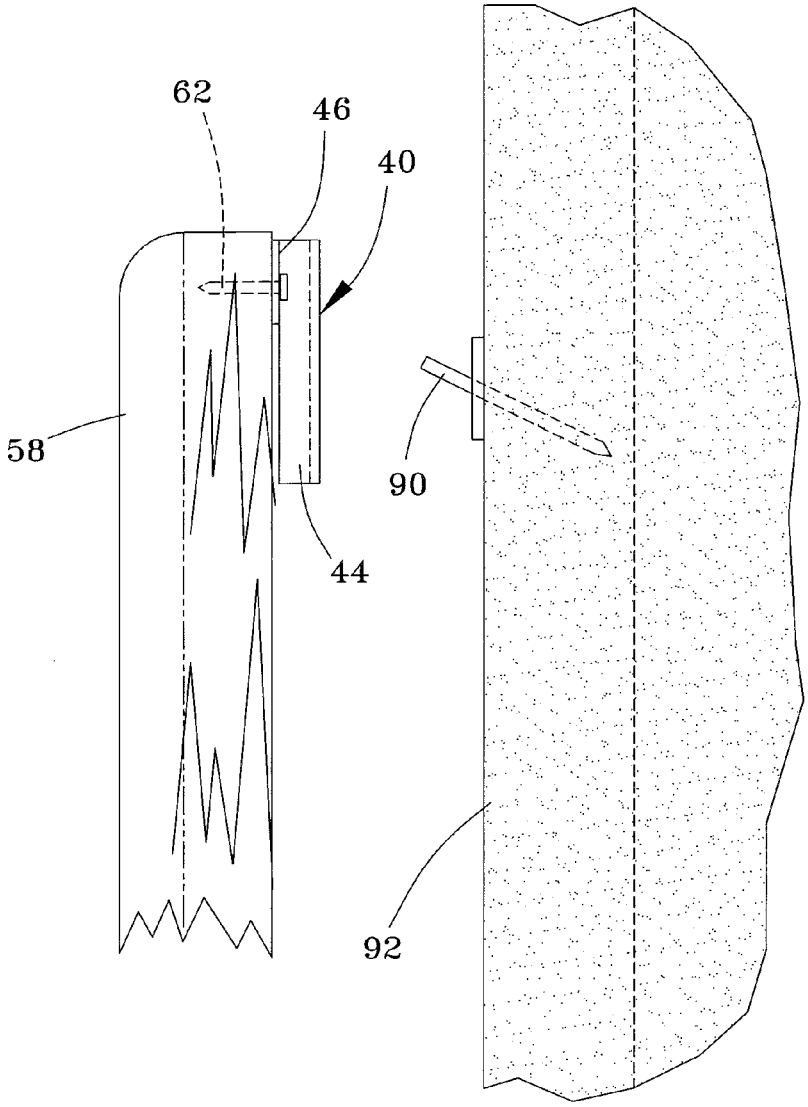
FIG. 10 is a side view of the hanger of FIGS. 5 and 6 secured to a frame and the frame ready for hanging on a wall.

FIGS. 1 through 10 depict hangers 10, 40, and 70 in accordance with different embodiments of the invention. Each hanger 10, 40, and 70 is adapted to hang a frame, such as picture frame, painting frame, etc., on a wall or any other desired surface that is generally vertical, as represented in FIG. 10. While the invention will be described in terms of hanging a framed object on a wall, it will become evident that hangers within the scope of this invention can be adapted for hanging a variety of objects from essentially any surface.

Figure 1:
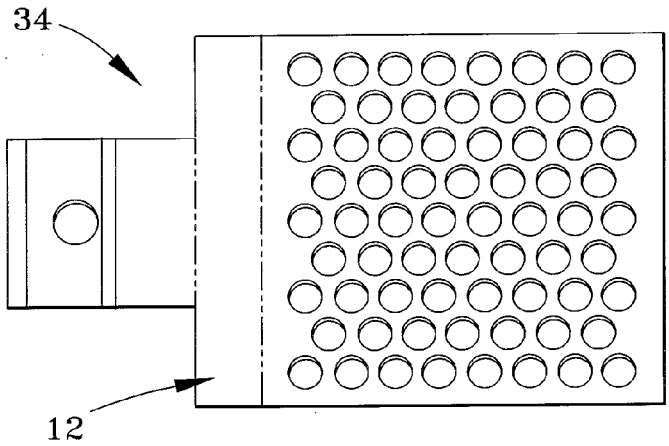
FIG. 1 is a plan view of a stamping for a hanger in accordance with a first embodiment of this invention.
Figure 2:
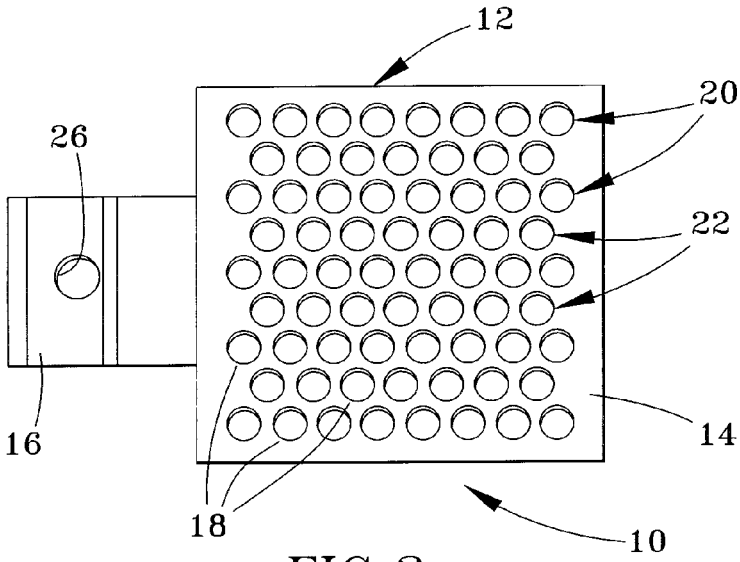
FIG. 2 is a plan view of the hanger of FIG. 1 following a forming operation.
Figure 3:
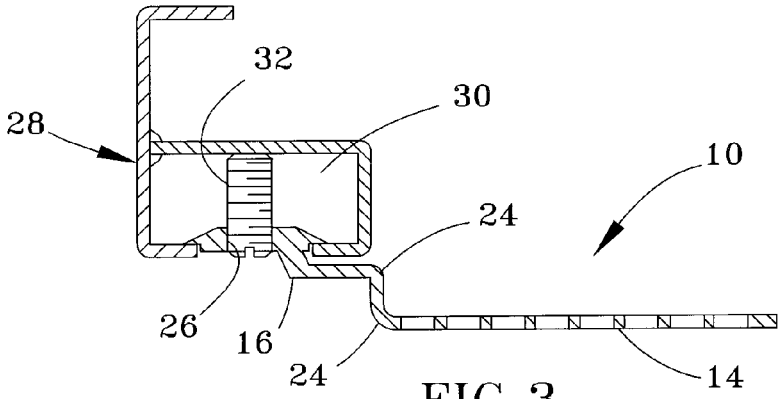
FIG. 3 is a side view of the hanger of FIG. 2, showing the hanger secured with a threaded fastener to a metal frame.

The hanger 10 according to a first of the embodiments is represented in FIGS. 2 and 3, and FIG. 1 represents a preform 34 from which the hanger 10 can be formed. Suitable materials for the hanger 10 include aluminum or another deformable metal, though it is foreseeable that the hanger 10 could be formed from a molded plastic material (thereby eliminating the requirement for the preform 34). The hanger 10 can be seen to have a unitary body 12 with a generally planar base 14 and a flange 16 extending from one edge of the base 14. The base 14 is depicted as having a generally rectangular peripheral shape, though other shapes could be used. A suitable size for the base 14 is about 25×25 mm up to about 40×40 mm, though one can appreciate that the dimensions of the base 14 as well as the overall dimensions of the hanger 10 could widely vary.

A number of openings 18 are present in the base 14. The openings 18 are preferably through-holes having circular shapes, though it is foreseeable that the openings 18 could be formed as deep recesses and/or have noncircular shapes. The openings 18 are shown arranged in a two-dimensional pattern of alternating rows 20 and 22. According to a preferred embodiment of the invention, each row 20 is offset from each row 22. In other words, the openings 18 of any row 20 is offset from the openings 18 in each immediately adjacent row 22. Also according to the preferred embodiment, each opening 18 of any row 20 is aligned with an opening 18 in each of the other rows 20, and each opening 18 of any row 22 is aligned with an opening 18 in each of the other rows 22. As a result, each opening 18 is offset in two directions from the nearest openings 18 of the two immediately adjacent row(s) 20 or 22. This pattern is intended to provide numerous openings 18 spaced as closely as possible from which a frame can be hung by a nail or other suitable feature. While it is foreseeable that the openings 18 could be randomly located in the base 14 to achieve the same goal, the regular pattern of openings 18 enables the base 14 to be formed from perforated panels or gratings that are commercially available and massed produced.

Because numerous closely-packed openings 18 are advantageous to the use of the hanger 10, the openings 18 are preferably sized not larger than necessary to receive the head of a nail or other hardware commercially available for hanging frames (e.g., the headless nail 90 shown in FIG. 10). For openings 18 having a circular shape as depicted in FIGS. 1 through 3, it is believed that the openings 18 can be formed to have diameters of about 2.2 millimeters with center-to-center spacings of about 3.0 millimeters without reducing the strength of the base 12 to the extent that its ability to safely support a picture frame would be compromised.

The flange 16 is generally parallel but offset from the base 14 through the formation of two ninety-degree bends 24, as best seen in FIG. 3 and understood by comparing the hanger 10 in FIG. 2 with the preform 34 in FIG. 1. A single threaded hole 26 is present in the flange 16 by which the hanger 10 can be secured to a picture frame 28 (FIG. 3) or any other suitable object. In FIG. 3, the end of the flange 16 is shown positioned within a channel 30 formed in the frame 28, and a set screw 32 serves to secure the flange 16 against the interior edges of the channel 30. This type of configuration is conventional for metal frames, and therefore does not require any further discussion. The central position of the flange 16 at one side of the base 14 allows any number of the hangers 10 to be installed anywhere along the length of any channel 30 of the frame 28, e.g., in the upper left and right hand corners of the frame 28.

Figure 4:
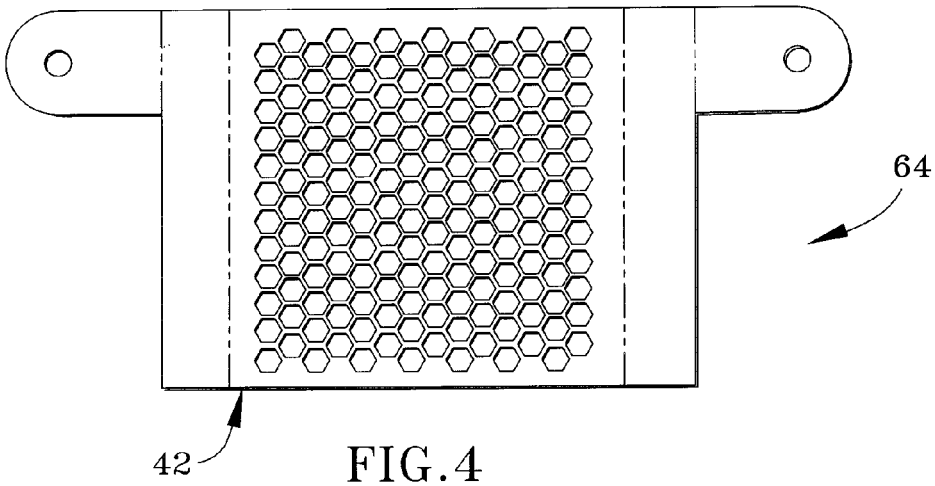
FIG. 4 is a plan view of a stamping for a hanger in accordance with a second embodiment of this invention.
Figure 5:
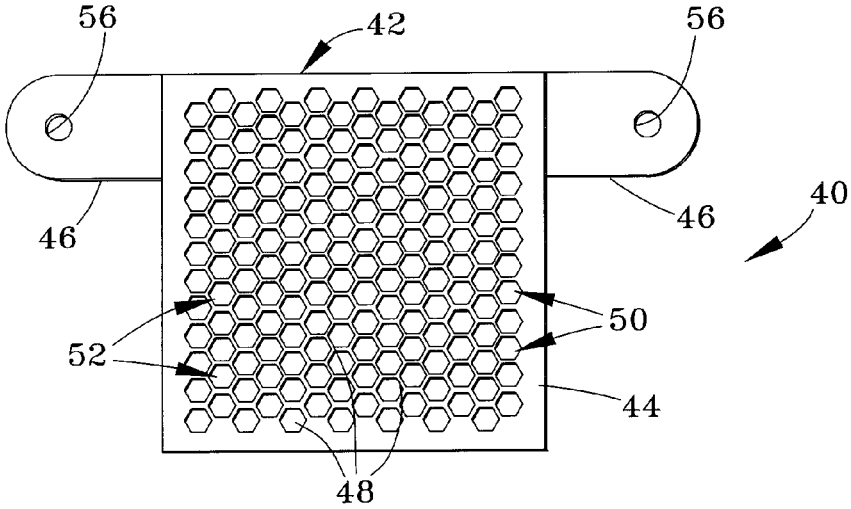
FIG. 5 is a plan view of the hanger of FIG. 4 following a forming operation.
Figure 6:
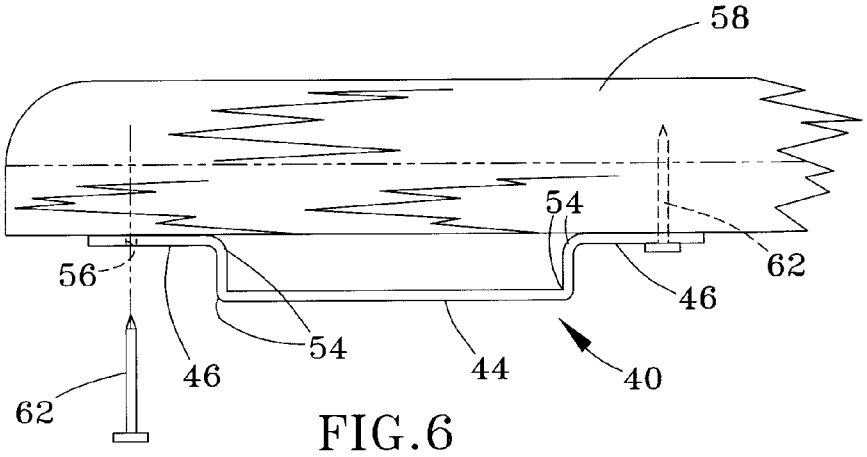
FIG. 6 is a side view of the hanger of FIG. 5, showing the hanger secured with nails to a frame.

FIGS. 5 and 6 depict the hanger 40 of a second embodiment, and FIG. 4 represents a preform 64 from which the hanger 40 can be formed. The hanger 40 is depicted as differing from the hanger 10 of the first embodiment primarily in terms of the shape of the openings 48 and the manner in which the hanger 40 is secured to a frame. Therefore, as with the hanger 10 of the first embodiment, the hanger 40 has a unitary body 42 with a generally planar base 44 and openings 48 arranged in a two-dimensional pattern of alternating rows 50 and 52, essentially as described before. In contrast to the embodiment of FIGS. 1 through 3, the openings 48 have hexagonal shapes and the single flange 16 of the first embodiment is replaced in the second embodiment with a pair of oppositely-disposed flanges 46.

The hexagonal-shaped openings 48 are advantageous for the purpose of increasing the density of the openings 48, enabling more openings 48 to be available for making finer adjustments than otherwise possible. For example, the hexagonal openings 48 can be sized to have a point-to-point cross-sectional dimension equal to the diameter of the openings 18 of FIGS. 1 through 3, yet spaced closer than the 3 mm center-to-center spacing noted for the openings 18 of FIGS. 1 through 3 without compromising the strength of the base 44. While shown only with the embodiment of FIGS. 4 through 6, it can be appreciated that any hanger within the scope of this invention can be formed to have hexagonal-shaped openings, as well as any other shaped openings.

The flanges 46 of the hanger 40 are generally parallel to each other but in a plane offset from the base 44 by two ninety-degree bends 54 formed in each flange 46 (FIG. 6). Each flange 46 is also formed to have a single through-hole 56 by which the hanger 40 can be secured to a picture frame 58 (FIG. 3) with a pair of nails 62 or any other suitable fastener. The flanges 46 are shown near adjacent corners of the base 14, enabling the hanger 40 to be secured to the frame 58 so that the base 14 extends downward away from the outer edge of the frame 58. As with the hanger 10 of FIGS. 2 and 3, any number of the hangers 40 to be installed anywhere along any side of the frame 58, e.g., in the upper left and right hand corners of the frame 58.

Figure 7:
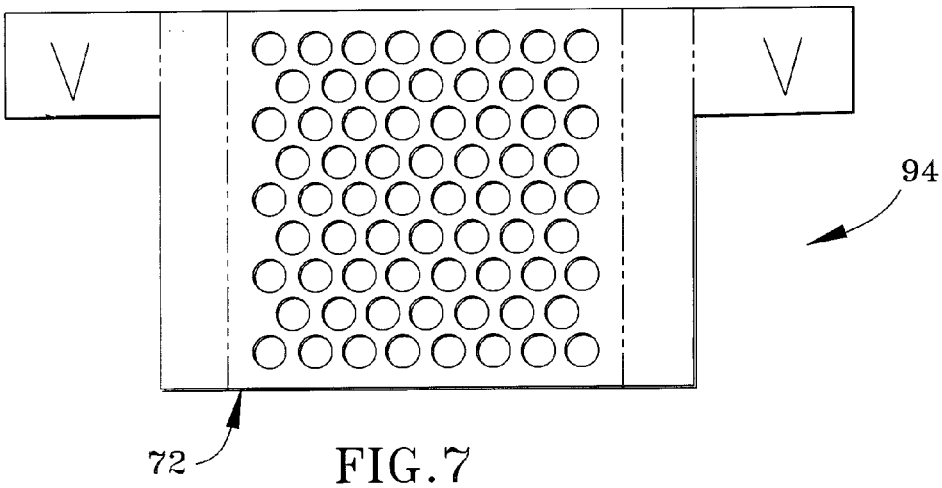
FIG. 7 is a plan view of a stamping for a hanger in accordance with a third embodiment of this invention.

Finally, FIGS. 8 and 9 represent the hanger 70 of a third embodiment, and FIG. 7 represents a suitable preform 94 from which the hanger 70 can be formed. Again, the hanger 70 differs from the other hangers 10 and 40 primarily in the manner in which the hanger 70 is secured to a frame. Therefore, the hanger 70 has a unitary body 72 with a planar base 74, and openings 78 arranged in a two-dimensional pattern of alternating rows 80 and 82, essentially as described before. As with the second embodiment, a pair of oppositely-disposed, substantially coplanar flanges 76 extend from the base 74, offset from the base 74 by two ninety-degree bends 84 (FIG. 9). However, instead of the through-holes 56 of the second embodiment, each flange 46 is formed to have an integral prong 86 formed during the stamping operation that produced the preform 94. By bending each prong 86 to extend at roughly a ninety-degree angle from its flange 76 in a direction away from the base 74, the prongs 86 can be driven into a picture frame 88 as represented in FIG. 9.

FIG. 10 depicts the hanger 40 secured to its frame 58, with the frame 58 ready for hanging on a nail 90 (or other suitable fastener) driven into a wall 92. As evident from FIG. 10, the hangers of this invention allow a frame to be mounted substantially flush to a wall. Furthermore, with each embodiment of the invention, the numerous, closely-spaced, offset openings 18, 48, and 78 provided on each hanger 10, 40, and 70 enable the user to drive a nail into a wall with less concern for the exact placement of the nail relative to the desired location of the frame, since the user has the choice of inserting the nail into any one of the openings 18, 48, and 78. By closely-packing the openings 18, 48, and 78 as shown in the Figures, very small incremental adjustments (e.g., about 0.3 mm) can be made to the frame in either or both the vertical and horizontal directions. A closely-packed pattern of openings 18, 48, and 78 also allows multiple hangers 10, 40, and 70 to be used in different combinations, since nails are likely to align with one and often several openings 18, 48, and 78 in their respective hangers 10, 40, and 70. As such, if two or more nails are used to hang a frame, the nails are likely to align with more than one combination of openings 18, 48, and 78 in the hangers 10, 40 and 70, enabling the frame to be adjusted both horizontally and vertical to achieve the desired orientation for the frame.

While the invention has been described in terms of particular embodiments, it is apparent that other forms could be adopted by one skilled in the art. For example, the physical configuration of a hanger could differ from that shown, and materials and processes other than those noted could be use. Therefore, the scope of the invention is to be limited only by the following claims.

What is claimed is:

1. A hanger for hanging an object on a fastener having longitudinally-opposed first and second ends, the first end of the fastener disposed in a generally vertical structure, and the second end of the fastener protruding from the generally vertical structure, the hanger comprising:

a body having a planar portion having a plurality of closely-packed openings formed therein, the openings arranged in a pattern defined as comprising nested rows of the openings, each opening sized to receive the second end of the fastener without deforming the opening, so as to mount the object to the vertical structure; and a mechanism for securing the hanger to the object.

2. The hanger of claim 1, wherein the openings have hexagonal shapes and are arranged in a honeycomb pattern defined as comprising nested rows of the hexagonal openings.

* * * * *